US008646578B2

(12) United States Patent
Hofmann

(10) Patent No.: US 8,646,578 B2
(45) **Date of Patent: *Feb. 11, 2014**

(54) EXTENDABLE MAST STRUCTURE FOR A FORK-LIFT TRUCK

(75) Inventor: Alexander Hofmann, Hamburg (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 1628 days.

This patent is subject to a terminal disclaimer.

(21) Appl. No.: 11/623,242

(22) Filed: Jan. 15, 2007

(65) Prior Publication Data

US 2007/0114097 A1 May 24, 2007

Related U.S. Application Data

(63) Continuation of application No. 10/937,028, filed on Sep. 9, 2004, now Pat. No. 7,188,709.

(30) Foreign Application Priority Data

Sep. 19, 2003 (DE) ..... 103 43 312

(51) Int. Cl.
*B66F 9/22* (2006.01)
*B66F 9/08* (2006.01)

(52) U.S. Cl.
USPC ..... 187/234; 414/631

(58) Field of Classification Search
USPC ..... 187/234, 272, 274; 254/89 H, 93 R, 254/93 VA; 414/629, 631
IPC ..... B66F 9/08,9/22
See application file for complete search history.

(56) References Cited

U.S. PATENT DOCUMENTS

| | | | | |
|---|---|---|---|---|
| 2,642,157 A * | 6/1953 | Milz | ..... | 187/227 |
| 2,643,894 A | 6/1953 | Schroeder | ..... | 280/44 |
| 3,170,672 A * | 2/1965 | Stoneberg | ..... | 254/93 R |
| 5,890,563 A * | 4/1999 | Avitan et al. | ..... | 187/228 |

FOREIGN PATENT DOCUMENTS

| | | | | |
|---|---|---|---|---|
| DE | 197 10 556 C2 | 3/1999 | | |
| DE | 199 39 925 A1 | 3/2001 | | |
| JP | 06001597 A * | 1/1994 | ..... | B66F 9/08 |
| JP | 07069594 A * | 3/1995 | ..... | B66F 9/08 |

* cited by examiner

*Primary Examiner* — Michael Mansen
*Assistant Examiner* — Stefan Kruer

(57) ABSTRACT

An extendable mast structure for a fork-lift truck, including an outer mast fixed to the carriage, the spaced columns being interconnected via upper and lower traverses, an extendable inner mast guided by said outer mast on which a load-carrying means is guided to be movable up and down and the columns of which are interconnected via upper or lower traverses or a cross-beam, one mast lift cylinder for each column of said inner mast supported on said outer mast, piston rods of which are adapted to be connected to said cross-beam, and setting means between said piston rods and cross-beam for an equalization of the lift, wherein a male-threaded setting component is attached to the upper end of said piston rod of one of said two mast lift cylinders and a female-threaded bushing is screwed onto the male thread of said setting component and has supporting surfaces for said cross-beam.

2 Claims, 4 Drawing Sheets

EXTENDABLE MAST STRUCTURE FOR A FORK-LIFT TRUCK

CROSS-REFERENCE TO RELATED APPLICATIONS

This application is a Continuation Application of application Ser. No. 10/937,028 filed on Sep. 9, 2004 U.S. Pat. No. 7,188,709 issued on Mar. 13, 2007, which in turn claimed priority from German patent application number 103 43 312.0 filed on Sep. 19, 2003.

STATEMENT REGARDING FEDERALLY SPONSORED RESEARCH

Not Applicable

FIELD OF THE INVENTION

This invention relates to an extendable mast structure for a fork-lift truck.

BACKGROUND OF THE INVENTION

Mast structures of this type have become known from DE 197 10 556 C2, for example. They have an outer mast which is attached to the industrial truck and possibly can be tilted. The outer mast has two spaced columns which are interconnected by a lower and an upper traverse. An inner mast has spaced columns which are guided on the columns of the outer mast and are interconnected via a cross-beam or traverse at the upper and lower ends. The lower end mostly also has mounted thereon a cross-beam on which the so-called free lift cylinder is supported that actuates the load-carrying means which is guided to be movable height on the inner mast. Supported on the outer mast are two mast lift cylinders the piston rods of which are adapted to be connected to the upper cross-beam.

It is natural for the mast lift cylinders to move linearly. Here, it needs to be ensured that the cross-beam is always arranged horizontally during such displacing motion. Moreover, there must not be any superfluous space in the mounting between the piston rods and cross-beam. Tolerances cannot be avoided while the mast lift cylinders are manufactured and the lift structure is assembled. Thus, differences of several millimeters might happen to occur in the lift of the two mast lift cylinders with respect to the cross-beam that cannot be accepted, however. Therefore, it is known to make an appropriate adjustment during the pre-assembly of mast components and their final assembly. Shims have been used hitherto for this purpose that were fitted on the cross-beam during the mounting of the piston rods. The drawback of the known construction is that further setting work can be performed solely by detaching the piston rods from the cross-beam. This is time-consuming all the more so since it requires two adjustments, i.e. during the assembly of the lift frame and during the mounting of the lift frame on the truck.

SUMMARY OF THE INVENTION

It is the object of the invention to provide an extendable mast structure for a lift frame of an industrial truck in which the adjustment of the mast lift cylinder and inner mast is made easier.

In an aspect of the invention, a male-threaded setting component is attached to the upper end of the piston rod of one of said two mast lift cylinders and a female-threaded bushing is screwed onto the male thread of the setting component. The bushing has supporting surfaces for said cross-beam. According to an aspect of the invention, the setting component can be formed by a sleeve which is adapted to be mounted at the end of the piston rod by means of screw bolt.

According to another aspect of the invention, the bushing can have clamping means for locating said bushing on said sleeve after an adjustment is made. For example, the clamping means can consist in that the bushing is split and a locking screw is provided to tighten the split portions towards each other, thus locating the bushing on the setting component.

According to another aspect of the invention, the cross-beam has bearing portions which are supported on the piston rod and the bushing. One bearing portion is hollow and is adapted to be slid approximately fittingly onto the upper portion of the bushing. At the end of the upper portion, the bushing has radial shoulder surfaces on which said bearing portion is supported.

During the adjustment of lift, for example, the two mast lift cylinders are extracted until they strike a stop. One mast lift cylinder serves as a reference and the lift of the second mast lift cylinder is adjusted to be equal to that of the first cylinder via an adjustment of the bushing by rotating it on the sleeve. The bushing is locked in place subsequently. It is understood that this adjustment procedure can also be performed later on or can be repeated with no particular effort required. Rather, the bushing merely needs to be released from its locked position and to be rotated to such an extent that the lifts of the two mast lift cylinders are made equal.

The invention involves a number of advantages. It allows to make an accurate lift adjustment of the lift frame as assembled, i.e. both on the test bench and in the truck. The time it requires is very short. This reduces the time necessary to assemble the lift frame and the truck. Also, an advantage of the invention is that tolerances in manufacture can be left to be coarser, specifically for lift cylinders. The means employed for this purpose are extremely simple and only low expenditure is required for manufacture and assembly.

The above description provides for an adjustment of lift via an appropriate connection between the piston rod of a mast lift cylinder and the cross-beam. It goes without saying that such an adjustment device can also be installed between the cylinder housing and the lower traverse of the outer mast.

The invention will be described in more detail below with reference to the drawings.

DETAILED DESCRIPTION OF THE PREFERRED EMBODIMENTS

Figure 1:
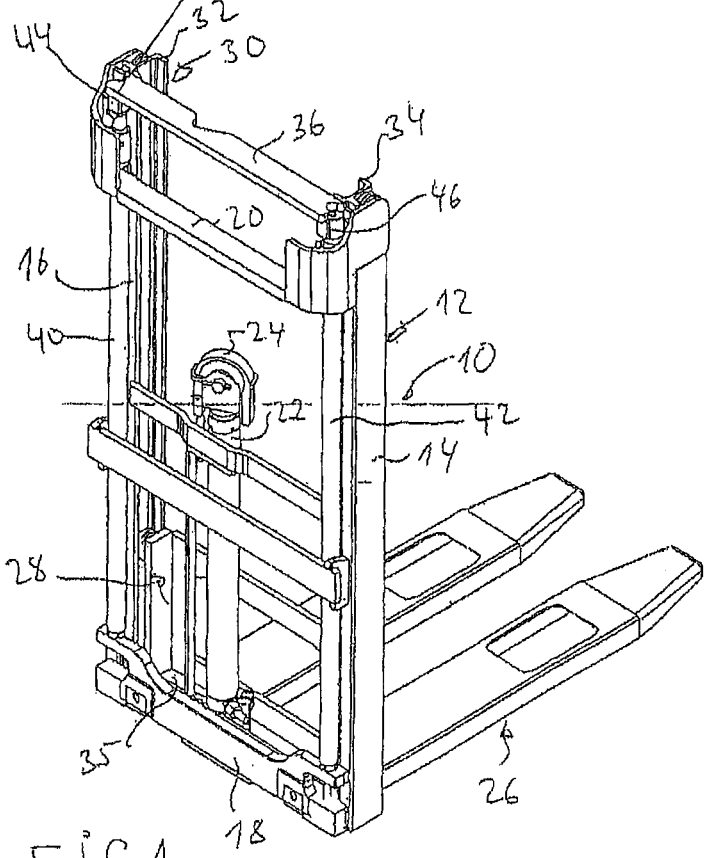
FIG. 1 shows a perspective view of a mast structure according to the invention.
Figure 3:
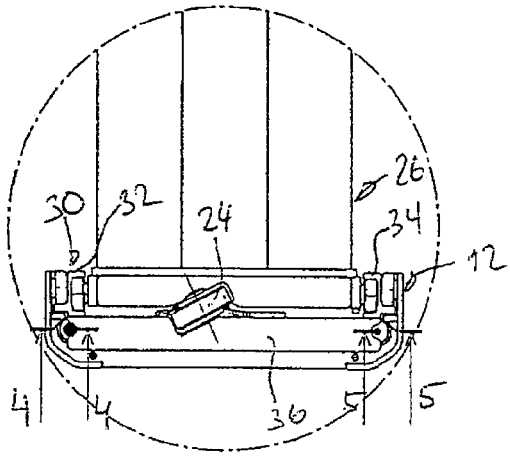
FIG. 3 shows a plan view of the mast structure of FIG. 1.

In FIG. 1, a mast structure is generally designated by 10. It has an outer mast 12 which has two spaced columns 14, 16 which are connected to each other by a lower traverse 18 and an upper traverse 20. An inner mast 30 guided internally on the outer mast 12 has an upper and a lower cross-beam 36, 35. The lower cross-beam 35 has supported thereon a free lift cylinder 22 which lifts or lowers a fork 26 via a chain, which is not shown, and a chain pulley 24 on the piston rod. The fork 26 is guided by means of a so-called fork back 28, in a manner which is not shown in detail, on the inner mast 30 which has spaced columns 32, 34 which are interconnected by the cross-beam 36 at the upper end.

Supported on the lower traverse 18 are mast lift cylinders 40, 42. Their piston rods are connected to the upper cross-beam 36 as will be explained in more detail below with reference to further figures.

Figure 2:
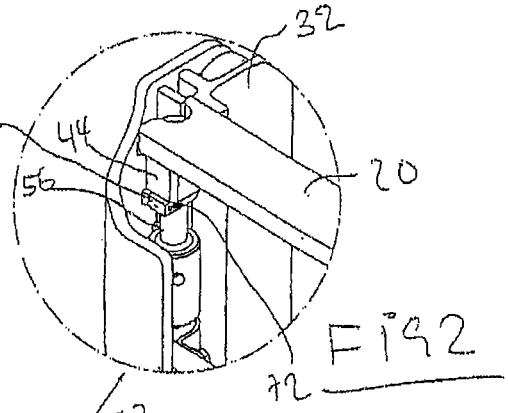
FIG. 2 shows an enlarged view of some part of the mast structure of FIG. 1.

As can be recognized from FIGS. 1 and 2 bearing portions 44, 46 are mounted at the underside of the cross-beam 36. The bearing portions 44, 46 can be seen more distinctly in FIGS. 4 and 5. The bearing portion 46 is mounted at the upper end of the associated piston rod 50 by means of a screw bolt 48. For this purpose, the piston rod has a female-threaded bore and the passage 52 through the bearing portion 46 has a necking as an abutment to the head of the a screw bolt. The end of the piston rod 46 has a gudgeon 54 which engages the passage 52. The lower surface of the bearing portion 46 is snugly supported at the end face of the piston rod 50 that faces it.

Figure 4:
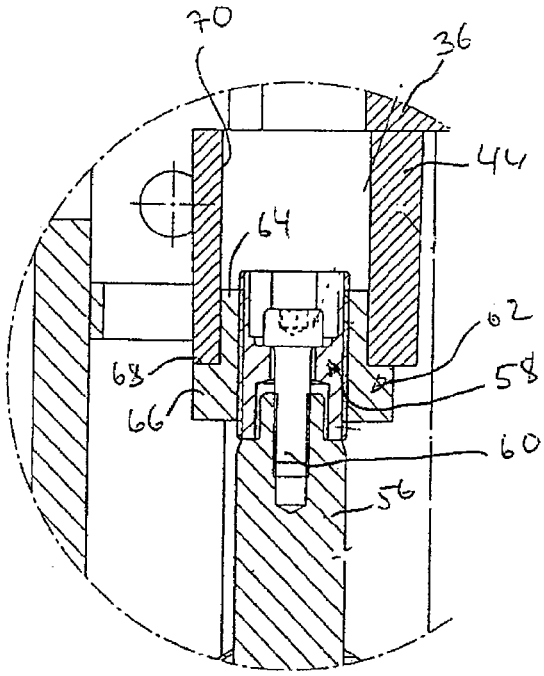
FIG. 4 shows a section through the representation of FIG. 3 along line 4-4.

The piston rod 56 of the other mast lift cylinder 40 (see FIG. 1) is of the same end shape as the piston rod 50. However, what can be seen in FIG. 4 is that a sleeve 58 is mounted on the end of the piston rod 46 by means of a screw bolt 60. The sleeve has a necking as an abutment to the head of the a screw bolt 60. The sleeve 58 has a male thread onto which a bushing 62 is screwed. The bushing 62 the outer contour of which can be rectangular, for example, exhibits an upper portion 64 and a lower portion 66. Shoulder surfaces 68 are formed between portions 64, 66. The bearing portion 44 has a passage 70 which is adapted to be slid approximately fittingly onto the upper portion 64 of the bushing 62 with its end being supported on the shoulder surfaces 68.

The bushing 62 is also outlined in FIG. 2. It can be seen as being split and accommodating a locking screw as is outlined at 72. This allows to fixedly clamp it onto the sleeve 58.

Figure 5:
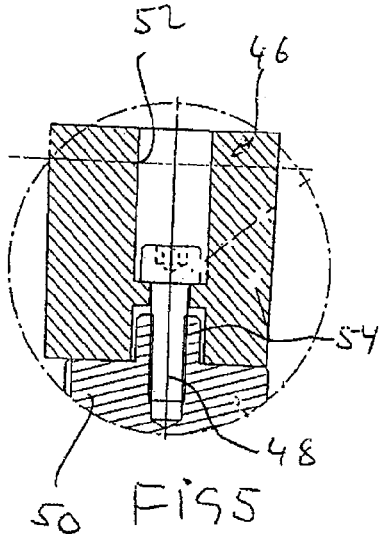
FIG. 5 shows a section through the representation of FIG. 3 along line 5-5.

During assembly, the connection of the cross-beam 36 to the piston rod 50 of the mast lift cylinder 42 is accomplished in the manner which is shown in FIG. 5 and is described above. Since the lift of the two mast lift cylinders 40, 42 will not be completely equal because of tolerances in the manufacture of the mast lift cylinders 40, 42 and other mast components an adequate adjustment needs to be made. This is done by means of the bushing 62 which is rotated on the sleeve 58 in the one or other sense until the desired lift position is reached. For example, the mast lift cylinders 40, 42 are caused to run to the end position, whereupon the lift adjustment described is made. Once it is done the bushing 62 is clamped in place by tightening the locking screw 72. A fresh adjustment is possible in an easy way by unlocking the locking screw 72 and rotating the bushing 62 by the desired measure.

Figure 6:
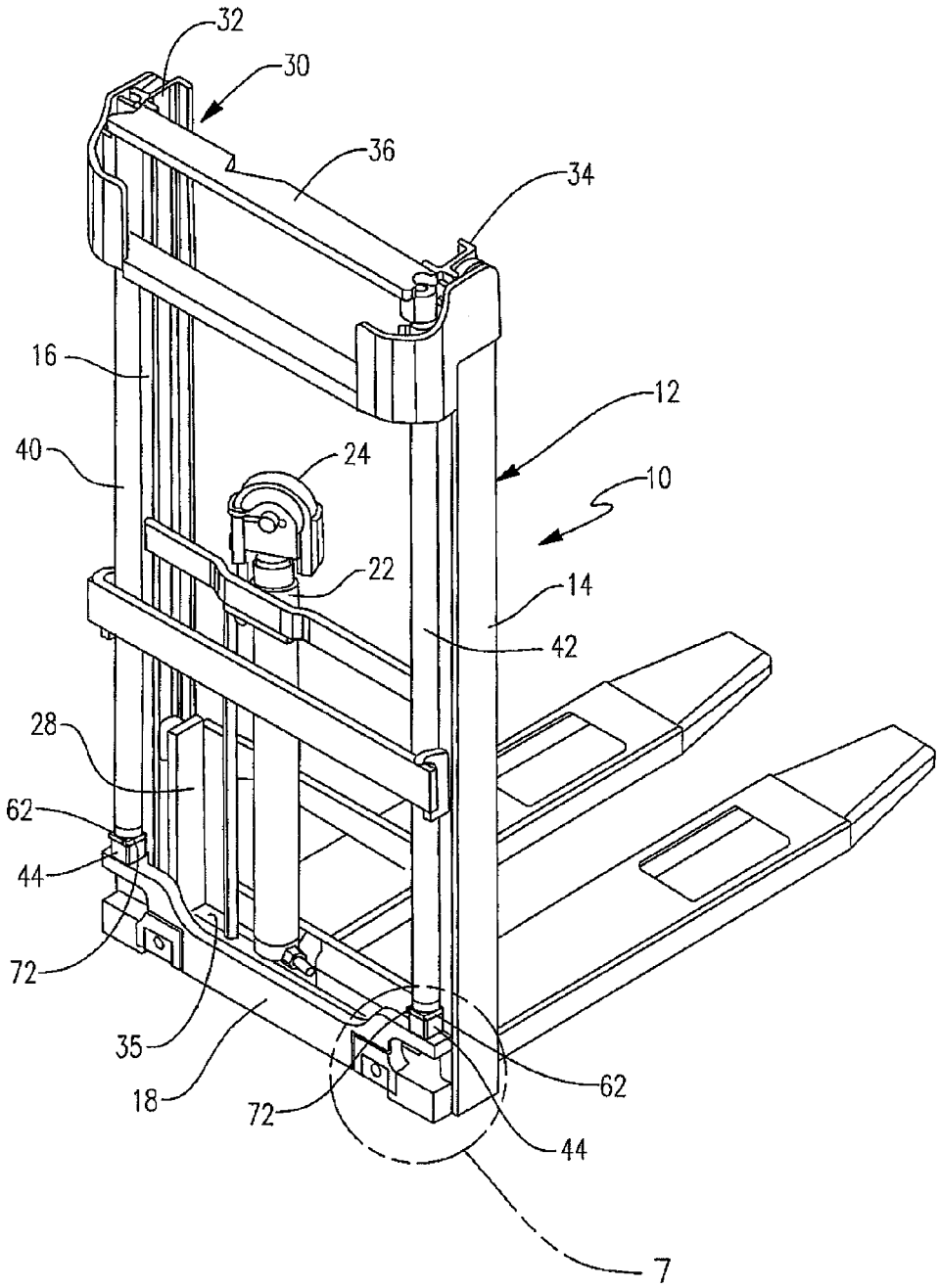
FIG. 6 shows a section with an adjustment device on the lower traverse of the mast structure.
Figure 7:
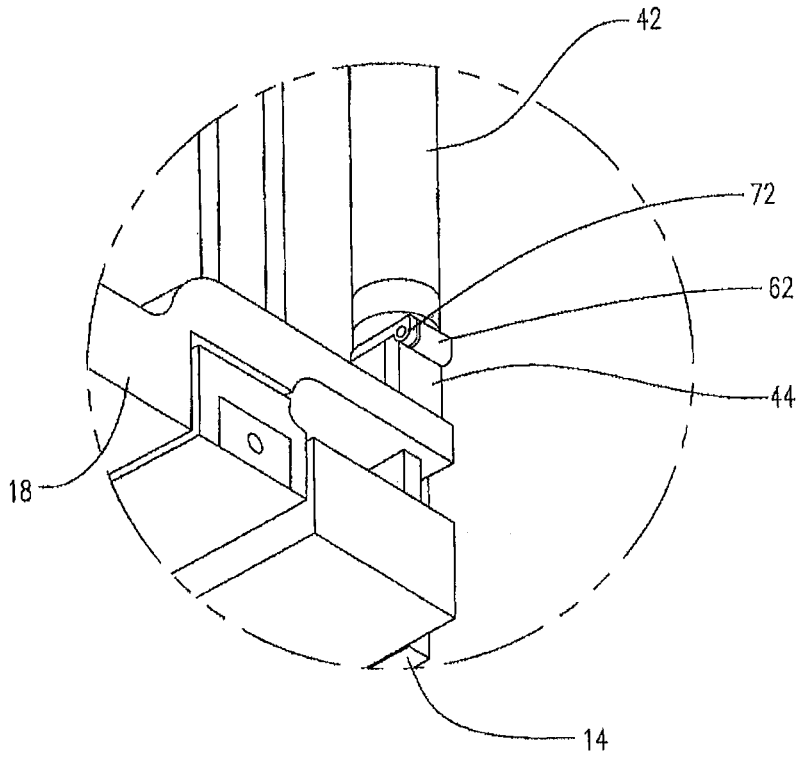
FIG. 7 shows an enlarged view of some part of the mast structure of FIG. 6.

Referring to FIGS. 6 and 7 there is shown an extractable mast structure 10 for a fork-lift truck, comprising an outer mast (12) fixed to the carriage the spaced columns (14, 16) of which are interconnected via an upper traverse (20) and a lower traverse (18). An expandable inner mast (30) is guided by the outer mast (12) on which a load-carrying member is guided to be movable up and down. The columns of the expandable inner mast (30) are interconnected via an upper and a lower traverse (20, 18) or a cross-beam (35, 36). A mast lift cylinder (40) is present for each column of the inner mast (30) which are supported on the outer mast (12). The mast lift cylinder has piston rods which are adapted to be connected to the cross-beam. A setting member is between the lift cylinders and the outer mast (12). A male-threaded setting component (sleeve 58) is mounted at the lower end of one of the mast lift cylinders and a female-threaded bushing (62) is screwed onto the male thread and is supported on the lower traverse (18) of the outer mast (12). The setting member is the bushing (62) and the locking screw (72) together with the sleeve (58).

The invention claimed is:

1. An extendable mast structure for a fork-lift truck, comprising:

an outer mast having spaced columns, wherein the outer mast is fixed to a carriage and the spaced columns are interconnected with via an upper and a lower traverse;

an extendable inner mast having columns, wherein the inner mast is guided by said outer mast a load-carrying member is on said inner mast guided to be movable up and down, and the columns of the inner mast are interconnected via an upper and a lower traverse;

one mast lift cylinder for each of said columns inner mast, wherein each mast lift cylinder is supported on said outer mast; and a setting member for an adjustment of lift, said setting member being disposed between at least one of said mast lift cylinders and said outer mast; wherein said setting member comprises:

a setting component which has a male thread and is mounted at a lower end of one of said mast lift cylinders, and a bushing which has a female thread screwed onto the male thread and which is supported on said lower traverse of said outer mast;

characterized in that said bushing has a clamping member for securing said bushing on said setting component;

characterized in that said bushing is split and a locking screw is provided to tighten said bushing on said setting component.

2. An extendable mast structure for a fork-lift truck, comprising:

an outer mast having spaced columns, wherein the outer mast is fixed to a carriage and the spaced columns are interconnected with via an upper and a lower traverse;

an extendable inner mast having columns, wherein the inner mast is guided by said outer mast a load-carrying member is on said inner mast guided to be movable up and down, and the columns of the inner mast are interconnected via an upper and a lower traverse;

one mast lift cylinder for each of said columns inner mast, wherein each mast lift cylinder is supported on said outer mast; and a setting member for an adjustment of lift, said setting member being disposed between at least one of said mast lift cylinders and said outer mast; wherein said setting member comprises:

a setting component which has a male thread and is mounted at a lower end of one of said mast lift cylinders, and a bushing which has a female thread screwed onto the male thread and which is supported on said lower traverse of said outer mast, characterized in that said setting component is a sleeve and is mounted on said lower end by a screw bolt, characterized in that said bushing has a clamping member for securing said bushing on said sleeve, characterized in that said bushing is split and a locking screw is provided to tighten said bushing on said sleeve.

* * * * *